US005660028A

United States Patent [19]

Neuhold

[11] Patent Number: 5,660,028

[45] Date of Patent: Aug. 26, 1997

[54] FRAMING APPARATUS

[75] Inventor: Arnold Neuhold, Farchant, Germany

[73] Assignee: L + N Plast-Vertriebe GmbH, Eglfing, Germany

[21] Appl. No.: 594,321

[22] Filed: Jan. 30, 1996

[30] Foreign Application Priority Data

Jan. 30, 1995 [DE] Germany ..... 195 02 875.9

[51] Int. Cl.[6] ..... B65B 63/00

[52] U.S. Cl. ..... 53/520; 53/284.2

[58] Field of Search ..... 53/284.2, 520

[56] References Cited

U.S. PATENT DOCUMENTS

| | | | |
|---|---|---|---|
| 2,892,295 | 6/1959 | McArthur | 53/520 |
| 3,019,579 | 2/1962 | Heckman | 53/284.2 X |
| 3,521,423 | 7/1970 | Koeppe et al. | 53/284.2 X |
| 3,788,031 | 1/1974 | Florjancic | 53/520 |
| 3,992,243 | 11/1976 | Berggren et al. | 53/520 X |
| 4,004,340 | 1/1977 | Urban | 53/520 X |
| 4,135,343 | 1/1979 | Urban et al. | 53/284.2 X |
| 4,231,214 | 11/1980 | Kiejzik | 53/520 |
| 4,237,678 | 12/1980 | Thompson | 53/520 |
| 4,391,082 | 7/1983 | Diesch | 53/520 |
| 4,543,771 | 10/1985 | Jensen et al. | 53/520 |
| 4,665,681 | 5/1987 | Facchini et al. | 53/520 |
| 4,787,766 | 11/1988 | Lorsch | 53/284.2 X |
| 4,934,128 | 6/1990 | Savio et al. | 53/520 |
| 5,168,688 | 12/1992 | Neuhold . | |
| 5,182,897 | 2/1993 | Gerrans | 53/520 |
| 5,195,653 | 3/1993 | Gerrans | 53/520 X |
| 5,222,347 | 6/1993 | Gerrans | 53/520 |
| 5,257,447 | 11/1993 | Stemmer . | |
| 5,276,954 | 1/1994 | Gerrans et al. | 53/520 X |
| 5,472,557 | 12/1995 | Storti | 53/520 X |

FOREIGN PATENT DOCUMENTS

| | | |
|---|---|---|
| 0472871 | 3/1992 | European Pat. Off. . |
| 0569665 | 2/1993 | European Pat. Off. . |
| 2666910 | 3/1992 | France . |
| 3335740 | 10/1984 | Germany . |
| 4029699 | 4/1992 | Germany . |

*Primary Examiner*—Daniel Moon

*Attorney, Agent, or Firm*—Sughrue, Mion, Zinn, Macpeak & Seas

[57] ABSTRACT

A framing apparatus is provided for the placement in a slide frame of a diapositive which is to be separated from a strip of film before placement. This apparatus defines a feed plane for the strip of film and a frame plane which is displaced with respect to the feed plane and in which the slide frame to be assembled comes to lie. A cutter assembly is located in the area of the framing plane in the direct vicinity of a film guide.

8 Claims, 1 Drawing Sheet

FRAMING APPARATUS

BACKGROUND OF THE INVENTION

The invention relates to a framing apparatus for placing a diapositive in a slide frame, the diapositive having to be separated from a strip of film before placement, comprising a film drive, a film guide arranged in front of the slide frame, an expanding apparatus for expanding the slide frame at one side, a feed plane for the strip of film and a framing plane displaced with respect to the feed plane and in which the slide frame to be assembled comes to lie, a means for completely inserting the diapositive into the slide frame, a deflection path between the two planes and a cutting means for separating the diapositive from the strip of film.

Such a framing apparatus is known, for example, from DE-OS 40 27 345 and DE-OS 40 29 699. In the first-mentioned document, the separating process for the diapositive takes place in the deflection region between the feed plane and the framing plane. Following separation of the diapositive from the strip of film, the bent-up trailing end of the separated diapositive is brought into the framing plane by means of a pivoting member. In the second-mentioned document, the separating process takes place in the area of the feed plane with the consequence that the cut rear end of the section of film must also be brought into the framing plane.

SUMMARY OF THE INVENTION

It is the object of the invention to provide a framing apparatus of the initially mentioned type which is more simply structured and also allows a reliable insertion of the diapositive into the frame.

This object is solved in accordance with the invention in that the cutting means is arranged in the area of the framing plane in the direct vicinity in front of the film guide.

As a result of this measure, the diapositive is separated from the strip of film at that location where the strip of film is already located in the framing plane. Consequently, a part by means of which the trailing end of the diapositive must be brought into the framing plane becomes superfluous. Additionally, the cutting means can be placed very close in front of the film guide, which is arranged immediately in front of the slide frame, so that only a little of the trailing end of the diapositive projects from the film guide and the introducing means for introducing the diapositive into the slide frame can be made with relatively small dimensions. As a result of the fact that the part for bringing the trailing end of the diapositive into the framing plane can be omitted, the apparatus is more simply structured and therefore delicate to a lesser extent. Further, it is particularly easy to introduce the last diapositive into the slide frame. It is also possible in a simple manner to frame individual diapositives.

The introducing means is preferably a pusher which is moveable substantially within the framing plane. This pusher can be relatively narrow because the trailing end of the diapositive is properly aligned across the width when the trailing end projects only slightly from the film guide.

The film drive is preferably arranged as a spiked feed roller in the deflection path between the planes and engages there in the perforations of the strip of film.

The cutting means preferably consists of at least one moveable knife (i.e. it can also consist of two moveable knives which cooperate in a scissors-like manner) which is or are moveable substantially perpendicularly to the framing plane and separate the diapositive at the location where it is aligned in the framing plane by the film guide.

In order to improve the alignment of the trailing end of the diapositive across its width, a film holding-down device is arranged between the film guide and the cutting means on the side of the framing plane which faces the feed plane. In order for the knife to be arranged as close as possible in front of the film guide, this film holding-down device preferably lies in the area of movement of the knife or knives and can be moved away by means of the knife movement.

The film guide has two guiding parts which are arranged to both sides of the framing plane. The film guide can be provided with expanding wedge surfaces for expanding the slide frame. As a result, the film guide lies in the expanding area of the slide frame with the result that, despite an appropriate length of the film guide, the knife or knives can again be arranged relatively closely in front of the slide frame in the area of the strip of film which is already located in the framing plane.

BRIEF DESCRIPTION OF THE DRAWINGS

The invention is described in more detail in the following with reference to an exemplary embodiment illustrated purely schematically in the drawings, in which.

DETAILED DESCRIPTION OF THE INVENTION

Figure 1:
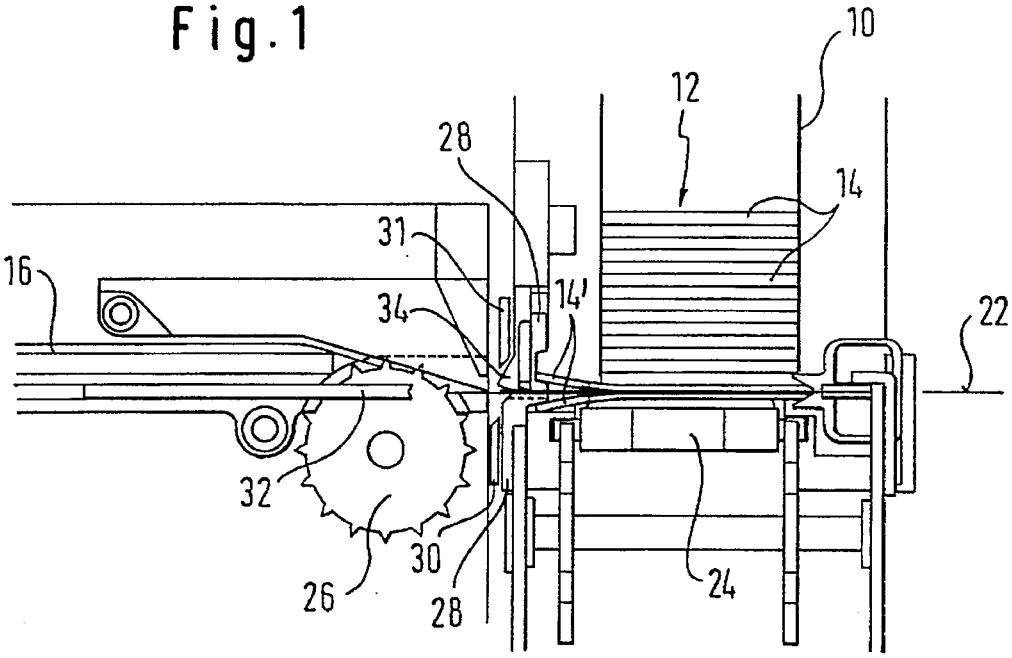
FIG. 1 shows a schematic complete side view of the framing apparatus on the scale of 1:1.

The device as a whole has a magazine 10 in which there is a stack 12 of diapositive slide frames 14.

At the left-hand side of the apparatus, there is a feed plane 16 along which the strip of film 18 is supplied. Parallel to this feed frame, there is defined a framing plane 22 in which the lowest slide frame 14' is located in the framing position. The lowest slide frame within the magazine 10 is located on a transport means 24 (transport chain).

A deflection area U in which the strip of film 18 is deflected from the feed plane 20 into the framing plane 22 is located between the two planes.

The film transport ensues by means of spiked feed rollers 26 which engage in the perforations of the strip of film. The lowest slide frame 14' is expanded at the left-hand side, i.e. at the introduction side. This takes place in this case by means of wedged surfaces, not shown, of a film guide 28 which, in accordance with the illustration in FIG. 2, consists of parts which are arranged on both sides of the framing plane 22. In front of the left-hand end, i.e. the left-hand side of the film guide 28, there are a lower knife 30 and an upper knife 31 which cooperate in a scissors-like manner and are therefore capable of being moved towards and away from each other in a direction perpendicular to the framing plane 22. Consequently, these knives 30, 31 are located in such a manner in the area of the framing plane that the strip of film 18 is cut in this framing plane 22 and, in fact, in such a manner that only a short section of the separated diapositive projects from the film guide 28.

Figure 2:
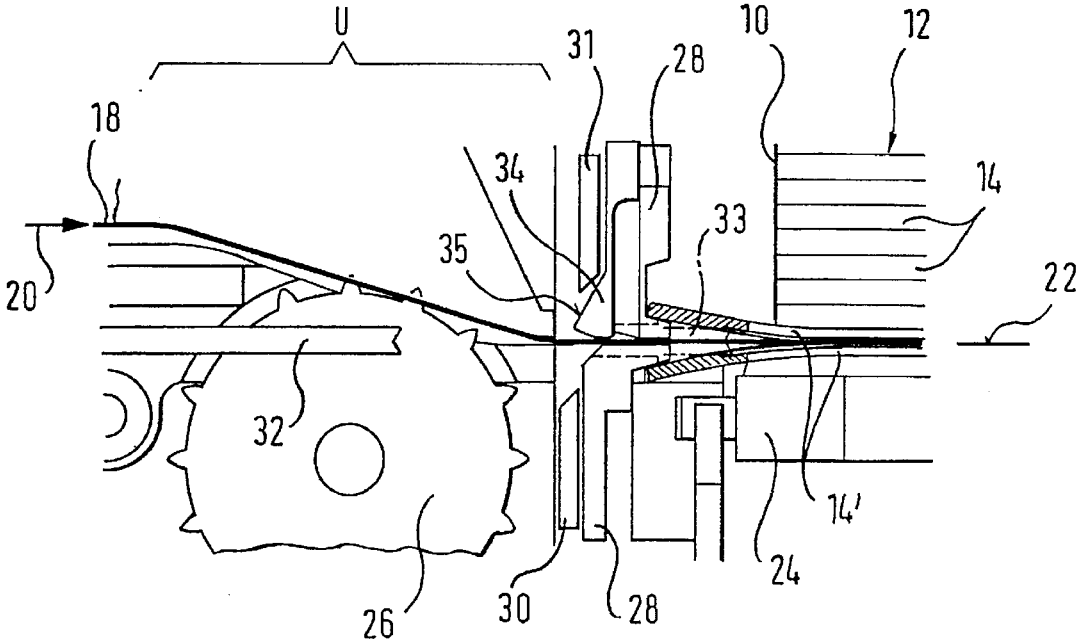
FIG. 2 shows an enlarged partial area of the apparatus on the scale of 2:1.

Substantially at the level of the framing plane 22, there is in the left-hand section of FIG. 2 a pusher 32 which is illustrated on the left-hand side in the starting position and, on the right-hand side within the expanded part of the slide frame 14', in the final position 33.

The mode of operation of the apparatus, which is especially suitable for small laborities and for use with short strips of film, is as follows.

The lowest slide frame 14' in the magazine 10 is moved by means of the transport chain 24 from a displaced position within the framing plane 22 into alignment with the feed of the strip of film 18. The left-hand end of the lowest slide frame 14' in the drawing is expanded in this case in accordance with the illustration in the drawings by the film guide 28 and is then located in the framing position as illustrated in the drawings. Subsequently, the strip of film is introduced with its leading section only partially into the expanded slide frame. In this case, the teeth of the spiked feed roller 26 engage in the perforation of the strip of film and a film holding-down device 34 presses flexibly and preferably spring-elastically onto the strip of film. After this, the knives 30, 31 carry out the process of separating the diapositive.

As the film holding-down device 34 is located in the area of movement of the knife 31 for the knives 30, 31 to be moved as close as possible towards the film guide 28, the knife 31 pushes the film holding-down device 34 to the side during its cutting movement. During the return movement of the knife 31, the film holding-down device 34 returns back into its starting position. For this purpose, the film holding-down device has an inclined surface 35 facing the knife 31.

Following separation of the diapositive, the strip of film is preferably pulled back by a specified amount so that the pusher 32 can be moved from the left to the right into the position 33 (without damaging the strip of film), on account of which the diapositive is completely inserted into the slide frame. After this, the pusher is placed back into the left-hand starting position illustrated in FIG. 2 and the slide frame 14' within the framing plane is then removed from the framing area.

As soon as the new slide frame is expanded and ready in the framing plane for insertion of another subsequent diapositive, the leading end of the strip of film and, thus, the next diapositive is newly partially introduced into the expanded slide frame by means of the spiked feed roller 26, during which it is held by the film guide 28 and the holding-down device 34. A separation of the diapositive then newly ensues and the complete insertion of the diapositive by means of the pusher 32 follows after this.

The last diapositive is pushed by the spiked roller 26 into the slide frame, which is actually also possible for individual diapositives. In this last process, there is no movement of the knives 30, 31.

What is claimed is:

1. A framing apparatus for placing a diapositive in a slide frame (14') subsequent to separating of the diapositive from a strip of film (18), comprising a film drive (26), a film guide (28) arranged in front of the slide frame (14'), an expanding means for expanding the slide frame at one side, a feed plane (20) for the strip of film (18) and a framing plane (22) which is displaced with respect to the feed plane and in which the slide frame (14') is disposed, an introducing means (32) for completely inserting the diapositive into the slide frame (14'), a deflection path (U) between said feed plane and said framing plane (20,22) and a cutting means (30,31) for separating the diapositive from the strip of film (18), characterized in that the cutting means (30,31) is arranged for cutting the diapositive from the strip of film in the frame plane (22) directly in front of the film guide (28).

2. A framing apparatus according to claim 1, characterized in that the introducing means is a pusher (32) which is moveable substantially within the framing plane (22).

3. A framing apparatus according to claim 1, characterized in that the film drive (26) is arranged in the deflection path (U).

4. A framing apparatus according to claim 1, characterized in that the cutting means consists of at least one moveable knife (30, 31) which is moveable substantially perpendicularly to the framing plane (22) for separating the diapositive from the strip of film when the diapositive is aligned in the framing plane (22) by the film guide (28).

5. A framing apparatus according to claim 1, characterized in that a film holding-down device (34) is arranged between the film guide (28) and the cutting means (30,31).

6. A framing apparatus according to claim 5, characterized in that the film holding-down device (34) lies in a path of movement of said at least one knife (30,31) and is capable of being moved away upon being engaged by said at least one knife.

7. A framing apparatus according to claim 1, characterized in that the film guide (28) has two guiding parts which are arranged on both sides of the framing plane (22).

8. A framing apparatus according to claim 7, characterized in that the film guide (28) is provided with expanding wedged surfaces for expanding the slide frame (14').

* * * * *